US008628049B2

(12) United States Patent
Ghatikar

(10) Patent No.: US 8,628,049 B2
(45) Date of Patent: Jan. 14, 2014

(54) LOW-PROFILE FASTENER ASSEMBLIES, PANEL MOUNTING SYSTEMS, AND METHODS

(75) Inventor: Venugopal R. Ghatikar, Salt Lake City, UT (US)

(73) Assignee: 3form, Inc., Salt Lake City, UT (US)

( * ) Notice: Subject to any disclaimer, the term of this patent is extended or adjusted under 35 U.S.C. 154(b) by 274 days.

(21) Appl. No.: 13/056,083

(22) PCT Filed: Jan. 14, 2009

(86) PCT No.: PCT/US2009/030992

§ 371 (c)(1),
(2), (4) Date: Jan. 26, 2011

(87) PCT Pub. No.: WO2009/154805

PCT Pub. Date: Dec. 23, 2009

(65) Prior Publication Data

US 2011/0121152 A1 May 26, 2011

Related U.S. Application Data

(63) Continuation of application No. 29/364,970, filed on Jun. 30, 2010, now Pat. No. Des. 634,612, which is a continuation of application No. PCT/US2009/030992, filed on Jan. 14, 2009.

(60) Provisional application No. 61/074,433, filed on Jun. 20, 2008.

(51) Int. Cl.
*F16M 11/00* (2006.01)

(52) U.S. Cl.
USPC ..... 248/201; 248/231.91; 52/506.05; 411/371.2

(58) Field of Classification Search
USPC ..... 248/27.1, 447.1, 201, 224.7, 231.91; 52/202, 506.05; 411/531, 371.2, 383
See application file for complete search history.

(56) References Cited

U.S. PATENT DOCUMENTS 2,180,633 A 11/1939 Holt
2,180,663 A 11/1939 Holt
4,187,892 A 2/1980 Simmons
5,257,490 A * 11/1993 Endo et al. ..... 52/511

(Continued)

FOREIGN PATENT DOCUMENTS

WO WO2009154805 12/2009

OTHER PUBLICATIONS

International Search Report and Written Opinion on PCT/US2009/030992 (Mailed Mar. 10, 2009).

*Primary Examiner* — Bradley Duckworth
(74) *Attorney, Agent, or Firm* — Workman Nydegger

(57) ABSTRACT

Low-profile fastener assemblies for mounting objects, such as decorative architectural resin panels, to a support structure at a standoff include a standoff barrel, threaded rod, and low-profile cap. The low-profile cap can have a curved profile configured to reduce its height while also allowing for one or more separated recesses to be formed therein. Implementations of the present invention also include a cap key configured to engage the one or more separated recesses of the low-profile cap for use in tightening the low-profile cap onto the threaded rod. In addition, one implementations of the present invention include systems having a plurality of panels mounted to one or more support structures using one or more low-profile fastener assemblies.

18 Claims, 4 Drawing Sheets

(56) References Cited

U.S. PATENT DOCUMENTS

| | | | | | |
|---|---|---|---|---|---|
| 5,391,028 | A * | 2/1995 | Charles | 411/374 |
| 5,540,514 | A | 7/1996 | Demars | |
| 5,644,889 | A * | 7/1997 | Getz | 52/713 |
| 5,697,592 | A * | 12/1997 | Matheny et al. | 248/231.91 |
| 5,860,538 | A * | 1/1999 | Duero et al. | 211/123 |
| 6,068,226 | A * | 5/2000 | Anders | 248/231.91 |
| 6,254,397 | B1 | 7/2001 | Elmer | |
| 6,430,894 | B1 * | 8/2002 | Chae et al. | 52/786.1 |
| 6,502,355 | B1 * | 1/2003 | Bori | 52/202 |
| 7,603,820 | B1 * | 10/2009 | Lai | 52/235 |
| D611,800 | S * | 3/2010 | Ghatikar | D8/354 |
| D623,506 | S * | 9/2010 | Ghatikar et al. | D8/382 |
| D634,612 | S * | 3/2011 | Ghatikar et al. | D8/382 |
| 7,971,398 | B2 * | 7/2011 | Tweedie | 52/173.3 |
| 8,128,043 | B2 * | 3/2012 | Walter | 248/224.7 |
| 8,171,690 | B2 * | 5/2012 | Ghatikar et al. | 52/506.05 |
| 8,196,363 | B2 * | 6/2012 | Hay et al. | 52/204.62 |
| 2002/0109056 | A1 * | 8/2002 | Weshler et al. | 248/220.22 |
| 2010/0102186 | A1 * | 4/2010 | Keyvanloo | 248/224.7 |
| 2010/0320340 | A1 * | 12/2010 | Hillstrom et al. | 248/205.1 |
| 2011/0064539 | A1 * | 3/2011 | Ghatikar et al. | 411/371.2 |
| 2011/0214379 | A1 * | 9/2011 | Norton et al. | 52/578 |
| 2012/0181402 | A1 * | 7/2012 | Putz et al. | 248/224.8 |

* cited by examiner

LOW-PROFILE FASTENER ASSEMBLIES, PANEL MOUNTING SYSTEMS, AND METHODS

CROSS REFERENCE TO RELATED APPLICATIONS

This application is a U.S. National Stage Application of PCT Application No. PCT/US09/30992, filed on Jan. 14, 2009, entitled "Low-Profile Fastener Assemblies, Panel Mounting Systems, and Methods," which claims the benefit of priority to U.S. Provisional Application No. 61/074,433, filed Jun. 20, 2008, entitled "Low-Profile Fastener Assemblies, Panel Mounting Systems, And Methods." This application is also a continuation of U.S. Design patent application Ser. No. 29/364,970, filed Jun. 30, 2010, entitled "Two-Piece Cap Assembly For Modular Panel Mounting Systems," which is a continuation of the afore mentioned PCT Application No. PCT/US09/30992, filed on Jan. 14, 2009, which claims the benefit of priority to U.S. Provisional Application No. 61/074,433, filed Jun. 20, 2008. The entire content of each of the aforementioned patent applications is incorporated by reference herein.

BACKGROUND OF THE INVENTION

1. The Field of the Invention

This invention relates to systems, methods, and apparatus for mounting and/or displaying panels as partitions, displays, barriers, treatments, or other structures.

2. Background and Relevant Art

Recent trends in building design involve adding to the functional and/or aesthetic characteristics of a given structure or design space by mounting one or more decorative panels thereto. This is at least partly since there is sometimes more flexibility with how the given panel (or set of panels) is designed, compared with the original structure. For example, panel materials include glass, wood, and polymeric resin materials, which can formed as panels to be used as partitions, walls, barriers, treatments, decor, signs, etc., in offices, homes, and other settings. Examples of resin materials include polyvinyl chloride or "PVC"; polyacrylate materials such as acrylic, and poly(methylmethacrylate) or "PMMA"; polyester materials such as poly(ethylene-co-cyclohexane 1,4-dimethanol terephthalate), or "PET"; poly(ethylene-co-cyclohexane 1,4-dimethanol terephthalate glycol) or "PETG"; glycol modified polycyclohexylenedimethlene terephthalate; or "PCTG"; as well as polycarbonate materials.

In general, resin materials such as these are now popular because they tend to be less expensive in most applications than materials such as glass or the like, where certain structural, optical, and aesthetic characteristics are desired. In addition, resin materials tend to be more flexible in terms of manufacture and assembly, since resin materials can also be relatively easily bent, molded, colored, shaped, cut, and modified in many different ways. Decorative resins can also provide more flexibility compared with glass and other conventional materials at least in terms of color, degree of texture, gauge, and impact resistance. Additionally, decorative resins have a fairly wide utility since they may be formed to include a large variety of artistic colors, images, and shapes.

As mentioned above, one particular use of decorative resins can be in the panel form, where the panel might be used in conjunction with a panel mounting system as part of a partition, display, barrier, treatment, or other structure. One conventional type of panel mounting system includes mounting panels to a structure (e.g., wall, ceiling, or corresponding frame) using one or more standoffs. In general, a standoff positions a panel at a "standoff" (or extended) position with respect to a support structure (e.g., a wall). The standoff position is a distance defined generally by a length of a portion of the standoff (i.e., the standoff barrel).

To this end, a conventional standoff typically includes a standoff barrel that attaches to the given support structure on one end, and a capped screw configured to twist inside the standoff barrel on an opposing end. The standoff screw is typically threaded through one side of a given perforation in a panel, and screwed into the standoff barrel on an opposing side of the panel perforation.

Unfortunately, conventional panel mounting systems such as these tend to suffer from a number of drawbacks. For example, mounting panels to a wall or other support using such conventional systems can be difficult and labor intensive. In particular, after mounting a standoff barrel to a support structure, an assembler is typically required to hold the panel in a desired mounting position, attempt to align a perforation in the panel with the standoff barrel, and align and thread the standoff screw through the perforation in the panel and into the standoff barrel. One will appreciate that the panel mounting process can be particularly difficult and cumbersome when using larger, heavier panels. Indeed, due to the awkwardness that may be caused by conventional panel mounting hardware, panels can be easily dropped or otherwise damaged during installation.

Additionally, the hardware itself can present a number of limitations. For instance, panels of different gauge may each require screws of different lengths. As such, an assembler either needs to keep a surplus of different length screws or order the screws and other hardware specifically needed for a particular panel system. If the wrong hardware is ordered, or the panel system requires modification, an assembler may not have the proper hardware on hand and may be forced to order new hardware, which can necessitate increased costs and time delays.

Another drawback of conventional panel mounting hardware is that capped standoff screws are often difficult to manufacture, which can increase cost. For example, manufacturing limitations can make it difficult to produce capped screws with longer lengths. In particular, such increased length, capped standoff screws often wobble and break during the manufacturing process. Additionally, increased length, capped standoff screws that do not fail during the manufacturing process, can nonetheless, include flaws due to manufacturing difficulty that can lead to premature failure.

Furthermore, conventional mounting hardware often does not account for the material properties of the particular type of panel being used; and thus, can lead to panel damage. For instance, many conventional mounting hardware options employ a metal-to-panel interface, which can create stress concentrations in both glass and acrylic panels that eventually lead to the creation of creaks and fissures in the panel. Additionally, conventional mounting hardware may not account for the unique material properties of resin panels. For example, resin panels may undergo significantly greater thermal expansion than metal or other conventional types of panels. Hardware that is too loose due to retraction of a panel can result in inappropriate shifting of the panel, which may cause the panel to rest in unintended positions against unintended hardware. Similarly, hardware that is too tight due to the expansion of a panel may result in one or more of the components digging into the panel, which can result in the creation of point stress that can lead to cracks and other damage.

In addition to the hardware itself, the tools required to use conventional mounting hardware can often lead to panel damage. For example, conventional panel mounting hardware, such as standoffs, typically requires a wrench or screw driver for assembly. Wrenches and other large tools are often cumbersome to use and can lead to inadvertent panel damage. For instance, assemblers often scratch or otherwise damage panels during tightening of the hardware. Scratching a panel during mounting is particularly common when an assembler is trying to both hold and align a panel and screw with a standoff barrel while attempting to tightened the screw. Similarly, assemblers often scratch panels when using hardware that necessitates using tools in close proximity to the panels, such as, for example countersunk screws and caps with a side, set screw.

Furthermore, conventional mounting hardware often is unsightly, too noticeable, or does not provide an appropriate aesthetic for desired design environments. In particular, this undesired aesthetic is often a result of the mounting hardware having a relatively "high profile" in that the mounting hardware protrudes somewhat with respect to the panel surface. The unpleasant aesthetic of conventional mounting hardware is often magnified when used with translucent, transparent, or other panels that magnify texture, light, color, and form. Thus, conventional mounting hardware may be unappealing to designers and architects seeking to obtain a certain aesthetic by using decorative architectural panels.

Accordingly, there are a number of disadvantages in conventional panel mounting systems and hardware that can be addressed.

BRIEF SUMMARY OF THE INVENTION

Implementations of the present invention solve one or more of the forgoing problems in the art with systems, methods, and apparatus for mounting panels as partitions, displays, barriers, treatments, or other structure with a great deal of functional versatility. For example, one or more implementations of the present invention include low-profile fastener systems and components that are adaptable and can be used with panels of varying gauge. In particular, some implementations of the present invention include low-profile fastener assemblies including a two-piece fastener, which allows panels to be quickly and efficiently assembled, disassembled, and reconfigured with great ease. Accordingly, implementations of the present invention can be easily adapted to the environment of use and provide a number of secure mounting options.

For example, a low-profile fastener assembly for securing an object, such as a decorative architectural panel, to a structure in an easy, efficient manner includes a standoff barrel configured to secure an object to a support structure at an extended distance. The low-profile fastener assembly also can include a rod configured to be removably coupled to the standoff barrel. Additionally, the low-profile fastener assembly can include a low-profile cap having a shoulder portion configured to be removably secured to the rod, and a head portion extending from the shoulder portion. The head portion of the low-profile cap can have a curved profile and two or more separated recesses extending into the curved profile that are configured to receive corresponding key elements.

In addition, a system for mounting one or more panels to a support structure at a standoff or extended distance can include a standoff assembly. The standoff assembly can include a standoff barrel configured to be secured to a support structure, a stand off rod having a first end configured to removably engage the standoff barrel; and a low-profile cap configured to removably receive a second end of the rod. The low-profile cap can have a plurality of separated slots equally offset from an apex thereof. The system can further include one or more panels configured to receive at least a portion of the standoff assembly, and a cap key including a plurality of separated elements configured to engage the plurality of separated slots.

In addition to the foregoing, a method of mounting a panel to a support structure at a standoff distance can involve securing a standoff barrel to a support structure, threading a first end of a rod within a recess of the standoff barrel, and inserting a second end of the rod through a perforation in a panel. The method can further include tightening a low-profile cap onto the second end of the rod by inserting a plurality of separated key elements extending from a cap key into a plurality of separated slots formed into a portion of a convex face of the low-profile cap offset from the apex of the low-profile cap.

Additional features and advantages of exemplary implementations of the present invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention provide systems, methods, and apparatus for mounting panels as partitions, displays, barriers, treatments, or other structure with a great deal of functional versatility. For example, one or more implementations of the present invention include low-profile fastener systems and components that are adaptable and can be used with panels of varying gauge. In particular, some implementations of the present invention include low-profile fastener assemblies including a two-piece fastener, which allows panels to be quickly and efficiently assembled, disassembled, and reconfigured with great ease. Accordingly, implementations of the present invention can be easily adapted to the environment of use and provide a number of secure mounting options.

Accordingly, one will appreciate from the description herein that the components of the present invention can significantly reduce the likelihood of damaging the panels, in addition to providing a secure mount of the panel to a structure. For instance, the low-profile cap of the present invention can be tightened using a cap key that reduces the likelihood of scratching a panel during installation. Additionally, one or more implementations of the present invention include systems and components, which in order to reduce likelihood of panel damage, provide a barrier between the panels and any harder mounting components.

Implementations of the present invention also provide systems, methods, and apparatus for mounting panels as partitions, displays, barriers, treatments, or other structure with a great deal of aesthetic versatility. For example, implementations of the present invention include components that are low-profile to reduce visibility, and such components can also include unique features which provide a desirable aesthetic.

As a preliminary matter, implementations of the present invention are described herein primarily with reference to mounting panels, such as resin panels. One will appreciate, however, that a panel, particularly a resin-based panel, is only one type of "structure" with which the low-profile fastener systems described herein can be used. For example, the low-profile fastener systems can be used to mount not only resin "panels," as such, but also glass panels, to a given support structure. Furthermore, one will appreciate that the low-profile fastener systems can also be used to mount other types of structures having different material compositions, such as objects comprising wood, stone, fiberglass, or the like, which may or may not exhibit primarily panel-like dimensions as described herein. Reference herein, therefore, to panels, or even resin panels, as such, is primarily for convenience in description.

Figure 1:
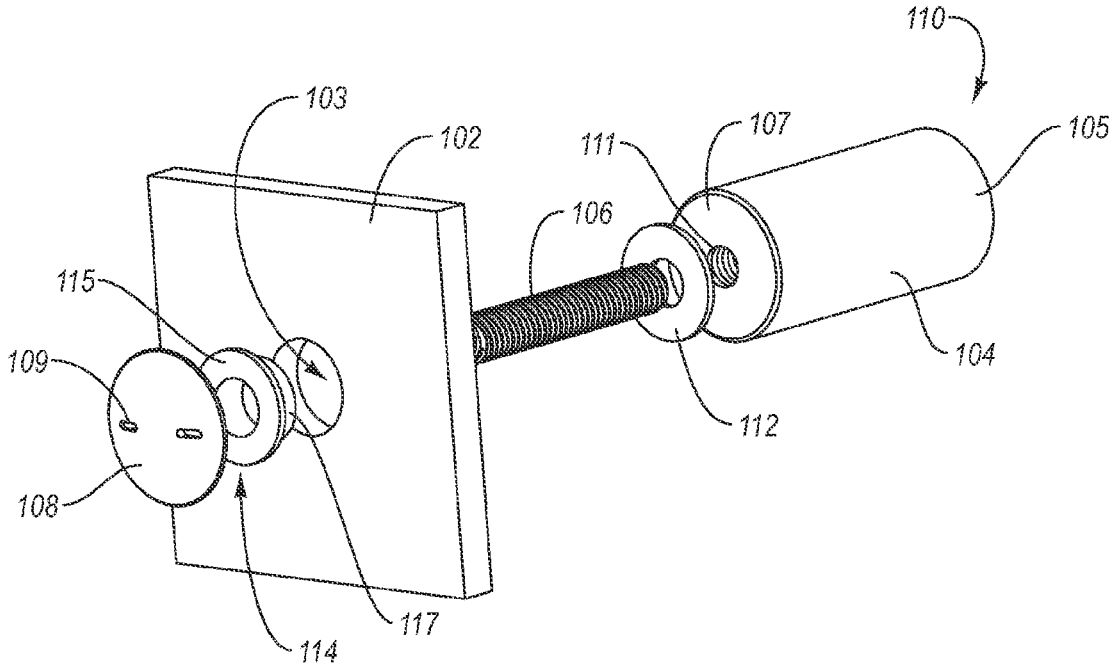
FIG. 1 illustrates an exploded, side perspective-view of a panel and low-profile fastener assembly in accordance with an implementation of the present invention.
Figure 2:
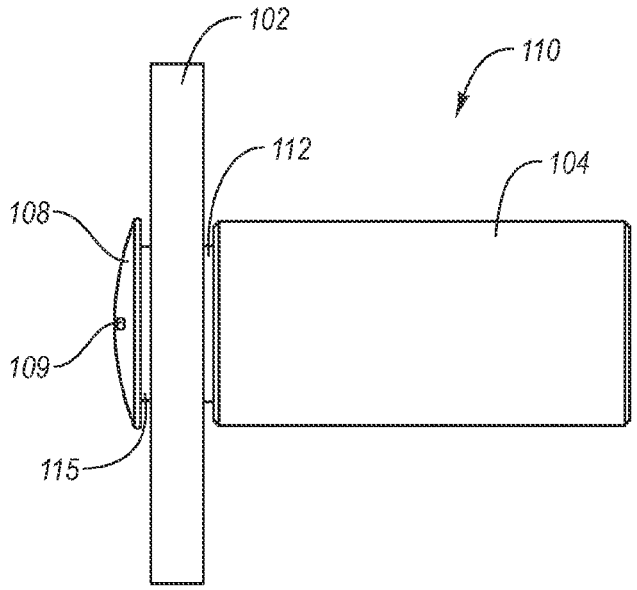
FIG. 2 illustrates an assembled side-view of the panel and low-profile fastener assembly of FIG. 1.

FIGS. 1-2 illustrate an exploded, perspective view and an assembled, side view of a low-profile fastener assembly 110 in accordance with an implementation of the present invention. As described in greater detail below, the low-profile fastener assembly 110 can allow a user (e.g., a manufacturer, assembler, engineer, designer, architect) to quickly and efficiently mount one or more panels 102 (e.g., a resin or glass panel) without damaging the panels during installation or after. Additionally, the low-profile fastener assembly 110 provides a pleasing aesthetic at least in part by reducing the visible profile of the mounting hardware.

As shown in FIGS. 1-2, the low-profile fastener assembly 110 can include a standoff barrel 104, a threaded rod 106, and a low-profile cap 108. Each of the standoff barrel 104, the threaded rod 106, and the low-profile cap 108 can be formed from a strong, light-weight material. According to some implementations of the present invention, the standoff barrel 104, the threaded rod 106, and the low-profile cap 108 can each be formed from a metal or alloy thereof, such as for example, aluminum. One will appreciate, however, that these and other components described herein can be prepared from any number of synthetic or naturally occurring resins, rubbers, glass, ceramics, and/or composites thereof.

In any event, FIG. 1 shows that the standoff barrel 104 can be configured to directly or indirectly secure a panel at an extended distance or "standoff" from a support structure (e.g., wall, ceiling, or floor). For example, a user can secure a distal end 105 (i.e., the end farthest from the user/assembler) of the standoff barrel 104 directly to a support structure (e.g., 101, FIG. 3) via an anchor, or indirectly via a frame or mounting plate secured between the standoff barrel 104 and the support structure. For example, according to some implementations of the present invention, the distal end 105 of the standoff barrel 104 can include a tapped recess (not shown) into which a user can fasten another threaded member (not shown). The user can then screw the other threaded member into any appropriate support structure, such as into one or more reciprocally threaded recesses, nuts, or anchors secured within or to a support structure 101 (e.g., FIG. 3).

Similarly, a proximal end 107 of the standoff barrel 104 can include an internally threaded receptacle 111 configured to receive the threaded rod 106. In particular, the threaded rod 106 can include external threads configured to engage internal threads of the internally threaded receptacle 111. In one implementation, the tapped recess for receiving threaded member and the internally threaded receptacle 111 for receiving threaded rod 106 can be the same recess. Thus, in such implementations, the internally threaded receptacle 111 can extend along the entire length of the standoff barrel 104. According to additional implementations, however, the internally threaded receptacle 111 for receiving threaded rod 106 can be a separate recess or be differently sized when compared with the tapped recess.

As illustrated by FIG. 1-2, a user can insert the threaded rod 106 within a perforation or through-hole 103 of a panel 102. Thus, the weight of the panel 102, or a portion thereof, can rest upon the threaded rod 106. The user can then secure a low-profile cap 108 to the proximal end of the threaded rod 106 to secure the panel 102 to the low-profile fastener assembly 110. As shown in FIGS. 1-2 and explained in greater detail below, the low-profile cap 108 can include a plurality of recesses or slots 109 within which a user can insert a tightening tool (or key) to secure the low-profile cap 108 to the threaded rod 106.

One will appreciate that the length of the threaded rod 106 can be based at least upon the gauge or thickness of the panel(s) 102 being mounted and/or the length of the standoff barrel 104. Thus, when a user mounts a relatively thick panel 102 to a support structure at a relatively large standoff distance, the user may employ a longer threaded rod 106. Similarly, when a user mounts a relatively thin panel 102 to a support structure at a relatively small standoff distance, the user may employ a shorter threaded rod 106.

Because the low-profile cap 108 and the threaded rod 106 are separate pieces, the low-profile cap 108 can be used with various lengths of threaded rods 106. Thus, the low-profile fastener assembly 110 can be used with any gauge of panel 102 and to mount a panel 102 at various standoff distances. Thus, the two-piece fastener (i.e., separate cap 108 and threaded rod 106) provides a user of the low-profile fastener assembly 110 with great flexibility. Also, the two-piece fastener reduces the number of different parts needed to assemble a panel system. For example, the same low-profile cap 108 can be used with panels of various or varying gauges.

Additionally, because the threaded rod 106 and low-profile cap 108 are separable pieces, the threaded rod 106 can be formed independently of the low-profile cap 108, which can greatly improve manufacturing yield (i.e., the stem of long, one-piece capped fasteners often breaks off during manufacturing). With a two-piece fastener, the threaded rod 106 can be manufactured separately from the low-profile cap 108, allowing the threaded rod 106 to be relatively easily manufactured to varying lengths without having to change any dies or tooling in the low-profile cap 108 itself As mentioned previously, the low-profile fastener assembly 110 can further include various features and components to aid in protecting the panel 102 from damage both during installation and after. For example, as will be discussed in greater detail herein below, the low-profile cap 108 and a tightening tool configured for use therewith can be configured to reduce the likelihood of scratching a panel 102 during installation. Additionally, FIGS. 1-2 illustrate that the low-profile fastener assembly 110 can include various washers and bushings (e.g., 114, 112, 140) to prevent the panel 102 from being damaged by contact with harder components of the low-profile fastener assembly 110.

For example, FIGS. 1-2 illustrate that the low-profile fastener assembly 110 can include a barrel washer 112, which a user can secure on the threaded rod 106 between the standoff barrel 104 and the panel 102. In one implementation, the barrel washer 112 comprises an at least partially flexible material such as a resin or rubber material, and thus provides a flexible, cushioning barrier between the harder standoff barrel 104 and the softer material of the panel 102. Thus, the barrel washer 112 can help ensure that the standoff barrel 104 does not scratch the panel 102. Additionally, the barrel washer 112 can help ensure that the edges of the standoff barrel 104 do not dig into—and create point stresses within—the panel 102 that may eventually lead to panel damage, such as cracks and fissures. The barrel washer 112 can be particularly helpful in preventing panel damage when used with glass and acrylic panels, which can be particularly susceptible to damage when mounted against a metal interface.

Additionally, the low-profile fastener assembly 110 can include a panel washer 114. The panel washer 114, similar to the barrel washer 112, can also comprise an at least partially flexible material, and thus act as a flexible barrier between the panel 102 and the harder components of the low-profile fastener assembly 110. As shown in FIG. 1, the panel washer 114 can include a hollow, cylindrical body 117 and a flange 115 extending radially outward from the cylindrical body 117.

The cylindrical body 117 can be sized and configured to be inserted within the through-hole 103 of the panel 102 and span at least the length thereof to help ensure that the threaded rod 106 and the low-profile cap 108 do not directly contact the panel 102. One will appreciate that the panel washer 114 can act as a barrier between the softer panel 102 and the harder threaded rod 106 and low-profile cap 108. Thus, the panel washer 114 can help ensure that the weight of the panel 102 resting upon low-profile fastener assembly 110 does not cause the threaded rod 106 or other component of the low-profile fastener assembly 110 to dig into or otherwise damage the panel 102.

As shown in FIG. 2, the flange 115 of the panel washer 114 can provide a barrier between the low-profile cap 108 and the panel 102. In one or more implementations, the outer diameter of the flange 115 can be approximately equal to the outer diameter of the low-profile cap 108. In at least one additional implementation, the outer diameter of the flange 115 can be less than the outer diameter of the low-profile cap 108. More specifically, in at least one implementation the outer diameter of the flange 115 can be approximately two-thirds (⅔) of the outer diameter of the low-profile cap 108. The smaller diameter of the flange 115 can help ensure that it is not visible (at least when viewed from the front).

One will appreciate that the barrel washer 112 and the panel washer 114 can be formed from polytetrafluoroethylene, rubber, nylon, or other suitable material that is light weight, durable, and that can provide a resilient barrier between the harder components of the low-profile fastener assembly 110 and a panel 102. In one or more implementations, the barrel washer 112 and/or the panel washer 114 can be formed from a material configured with approximately the same or similar coefficient of thermal expansion as the panel 102. Thus, the barrel washer 112 and the panel washer 114 can expand and contract at approximately the same rate as the panel 102 and thereby help ensure that there is always an adequate barrier between the harder components of the low-profile fastener assembly 110 and the softer panel 102.

One will appreciate in light of the disclosure herein, that in addition to helping prevent panel damage, the low-profile fastener assemblies 110 of the present invention can also help reduce the visibility of mounting hardware, and thus, help magnify the aesthetic properties of a given panel 102 or panel system. For example, in at least one implementation of the present invention, the transparency and color of at least one of the panel washer 114 and barrel washer 112 can correspond to the transparency and color of the panel 102 with which it is used. Thus, the panel washer 114 and barrel washer 112 each can blend in with the panel. In one or more implementations, the color and transparency of the spacer bushing 140, panel washer 114, and barrel washer 112 each can differ from that of the panel 102 in order to provide a desired aesthetic.

Additionally, as shown in FIG. 2, the low-profile cap 108 can reduce the noticeablity of the low-profile fastener assemblies 110. For example, as shown in FIG. 2, the low-profile cap 108 can have a reduced height or extend only a small distance away from the panel 102. According to some implementations of the present invention, the height of the low-profile cap 108, or the distance the low-profile cap 108 extends away from the panel 102 (and more particularly the flange 115), can be 0.12 inches or less. One will appreciate that the decreased height of the low-profile cap 108 can reduce the visibility of the low-profile fastener assembly 110, particularly when viewed from the side.

Furthermore, the low-profile cap 108 can have features that may further reduce its visibility. For example, FIG. 2 illustrates that the low-profile cap 108 can have a convex or curved shape/profile. Thus, the low-profile cap 108 may have a height that varies across its profile. One will appreciate that varying the height of the low-profile cap 110 can both reduce the visual and tactile noticeability of the low-profile fastener assembly 110.

Figure 3:
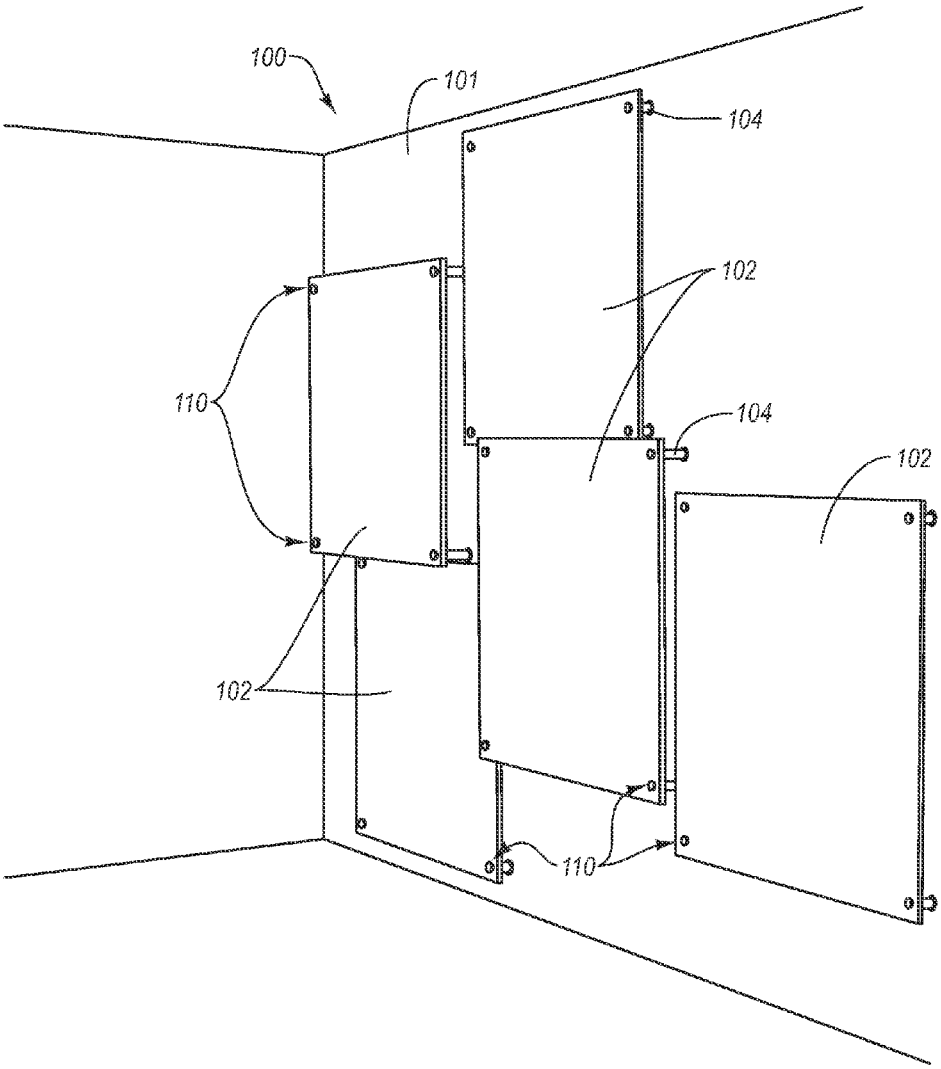
FIG. 3 illustrates a schematic diagram of a plurality of panels mounted to a support structure via a plurality of low-profile fastener assemblies in accordance with an implementation of the present invention.

As mentioned previously, the low-profile fastener assembly 110 can be used to securely mount panels 102 to a support structure without damaging the panels 102, while also providing a pleasing aesthetic. For example, FIG. 3 illustrates a schematic diagram of a system 100 comprising a plurality of panels 102 mounted as a display to a support structure 101. As shown, one or more low-profile fastener assemblies 110 secure each panel 102 of the plurality of panels 102 to the support structure 101.

As discussed above, each of the low-profile fastener assemblies 110 can include a standoff barrel 104, which holds or positions a portion of a panel at an extended distance or "standoff" from a support structure. For example, FIG. 3 illustrates that a standoff barrel 104 secures each panel 102 to the support structure 101 by. As shown in FIG. 3, the standoff barrels 104 can have varying lengths, and thus, the panels 102 can be secured at varying distances from the support structure 101, in order to create a desired aesthetic.

Figure 4:
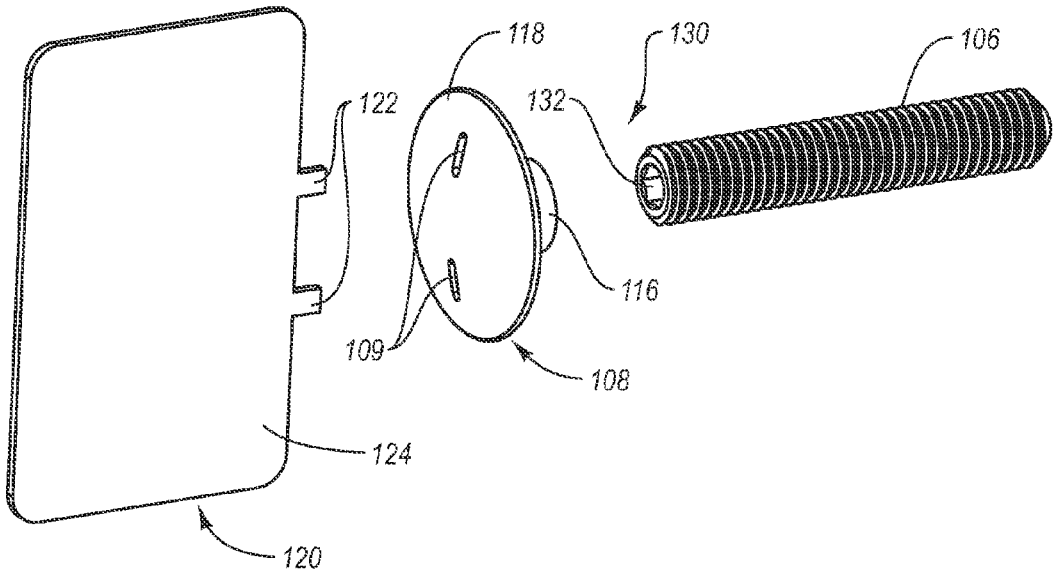
FIG. 4 illustrates an exploded, side perspective-view of a two-piece fastener of the low-profile fastener assembly of FIG. 1 and a cap key configured to tighten the two-piece fastener.

FIG. 4 describes a number of details and features of the two-piece fastener 130 of the low-profile fastener assembly 110. As mentioned previously, the two-piece fastener 130 can include a low-profile cap 108 and a threaded rod 106. The threaded rod 106 can be configured with a fitting 132 for turning the threaded rod 106 into the threaded receptacle 111 of standoff barrel 104. In particular, the fitting 132 can include one or more internal bevels configured to correspond with any one or more of an "allen," "phillips," or "flathead" fitting.

The low-profile cap 108 can include a shoulder 116 and a head 118. As shown in FIG. 4, the shoulder 116 can extend from the head 118. The shoulder 116 of the low-profile cap 108 can be configured to be inserted within the panel washer 114 (FIG. 1). In at least one implementation, the shoulder 116 of the low-profile cap 108 can be configured to have a press fit engagement with the panel washer 114. The shoulder 116 can also include internal threads configured to engage the external threads of the threaded rod 106. Once a user has placed the shoulder 116 within the panel washer 114, and therefore the panel 102 (FIG. 2), the user can tighten the low-profile cap 108 onto the threaded rod 106 by tightening or applying a torque to the low-profile cap 108.

As shown in FIG. 4, the low-profile cap 108 can include one or more recesses 109 configured to engage a cap key 120, as explained in detail below. The low-profile cap 108 can have a convex shape (i.e., a curved profile), as shown in FIG. 4 and described above, to allow the one or more recesses 109 to extend within the head 118 of the low-profile cap. The convex shape of the low-profile cap 108 can also provide a unique aesthetic.

The cap key 120 can be used to tighten the low-profile cap 108 onto the threaded rod 106. In particular, the cap key 102 can include one or more key elements or teeth 122 extending from a body 124. According to some implementations of the present invention, the individual key elements 122 can be separated from each other as shown in FIG. 4. The one or more key elements 122 can be configured to engage (or be received within) one or more recesses 109 within the head 118 of the low-profile cap 108. Thus, a user can tighten the low- profile cap 108 onto the threaded rod 106 by inserting the key elements 122 into one or more of the recesses 109 of the low-profile cap 108. The user can then apply a torque to the cap key 120 to turn and tighten the low-profile cap 108 onto the threaded rod 106.

According to some implementations of the present invention, the cap key 120 can be formed out of aluminum. One will appreciate, however, that the cap key 120 can also be formed from any suitable material that is light-weight and strong. In at least one implementation, the cap key 120 can be formed from a thin sheet of metal. Specifically, the cap key 120 can be formed using a punch. This increases the ease with which the cap key 120 can be manufactured, while also ensuring the cost of the cap key 120 is minimal.

The relatively small size of the cap key 120 can allow a user to easily manipulate it in a single hand. In particular, according to some implementations of the present invention, the cap key can be sized and configured to be held substantially entirely within the palm of a user's hand. The small size and manipulability of the cap key 120 can help ensure that a user does not scratch the panel 102 while tightening the low-profile cap 108 onto the threaded rod 106. In particular, the small size of the cap key 120 can require a user to position their hand proximate the low-profile cap 108 in order to engage the key elements 122 of the cap key 120 within the recesses 109 of the low-profile cap 108. The proximity of a user's hand to the low-profile cap 108 (and to the panel 102) can reduce the likelihood of the user missing the low-profile cap 108 and inadvertently digging the cap key 120 into the panel 102.

As shown in FIG. 4, the body 124 of the cap key 120 can be rectangular in at least one implementation. In one or more additional or alternative implementations of the present invention, however, the body 124 can comprise a square, circular, or other shape. For example, in at least one implementation, the body 124 of the cap key 120 can include an ergonomical configuration. For instance, the body 124 can include recesses configured to receive a user's fingers, or the body 124 can be contoured to correspond to the palm of a user's hand.

Figure 5A:
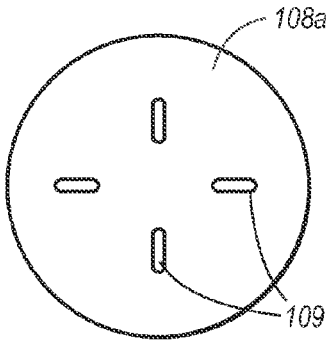
FIG. 5A illustrates a plan view of one exemplary low-profile cap in accordance with an implementation of the present invention.
Figure 5B:
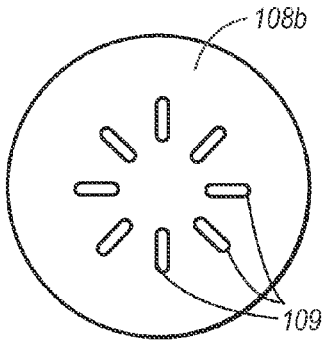
FIG. 5B illustrates another plan view of another exemplary low-profile cap in accordance with an implementation of the present invention.
Figure 5C:
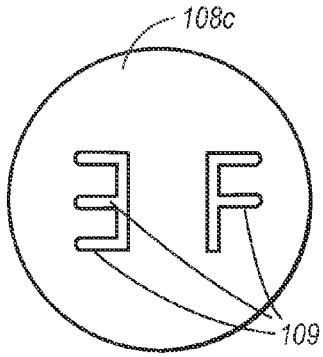
FIG. 5C illustrates still another plan view of a low-profile cap in accordance with an implementation of the present invention.

FIGS. 5A-5C illustrate various examples of low-profile caps 108 according to implementations of the present invention. As shown, each of the low-profile caps 108 has a different number of recesses 109 formed in different arrangements to provide a different aesthetic. For instance, the low-profile cap 108*a* shown in FIG. 5A includes four recesses 109 formed in the head 118 in the shape of a cross. The low-profile cap 108*b* shown in FIG. 5B, on the other hand, includes eight recesses 109 formed in the head 118 in the shape of a star. In addition, FIG. 5C illustrates an example in which the one or more recesses 109 of the low-profile cap 108*c* form the initials "3F".

One will appreciate, however, that the one or more recesses 109 can form any number of initials, numbers, or words. Furthermore, the cap key 120 can include any number of key elements 122 for any number of functional and/or aesthetic purposes. Specifically, the low-profile cap 108 can include any number of recesses 109 formed in any number of positions on the head 118 of the low-profile cap 108 in order to provide a desired aesthetic.

In addition, some implementations of the present invention can include low-profile caps 108 where each recess 109 is separated from every other recess 109. For example, FIGS. 5A and 5B illustrate that each of the recesses 109 are separated (i.e., not interconnected or do not touch any of the other recesses) from all of the other recesses 109. This separation can allow the key elements 122 of the cap key 120 to engage multiple portions of the low-profile cap 108.

For example, the key elements 122 can engage recesses or slots 109 formed on both sides of the apex of the low-profile cap 108. The multi-portion or position engagement of the cap key 120 and the low-profile cap 108 can help ensure that the key elements 122 of the cap key 120 are not inadvertently disengaged from the plurality of recesses 109 during tightening (as may sometimes be the case with conventional flathead or Phillips head fittings). Thus, the multi-portion engagement of the cap key 120 and the low-profile cap 108 can help ensure that a user does not scratch or otherwise damage a panel 102 during installation.

Furthermore, the separated recesses 109 can help distribute the torque applied to the low-profile cap 108 by the cap key

120. In other words, a single recess or group of connected recesses will not have to receive all of the torque required to tighten the low-profile cap 108 onto the threaded rod 106. Thus, the distribution of the torque across multiple separated recesses can help prevent the key elements 122 of the cap key 120 from enlarging or otherwise damaging the recesses 109 of the low-profile cap 108 during tightening. Other implementations of the present invention, however, can include crossing, intersecting, or otherwise non-separated recesses.

Additionally as shown in FIGS. 5A-5B, the recesses 109 of the low-profile cap 108 can be positioned symmetrically around the apex of the low-profile cap 108. According to some implementations, the recesses 109 can be formed at positions equally offset from the apex of the low-profile cap 108 as shown in FIGS. 4, 5A, and 5B. Furthermore, as shown in FIGS. 5A-5C the apex and surrounding area of each low-profile cap 108 may not include any recesses 109.

FIGS. 4, 5A, and 5B also illustrate that, according to some implementations of the present invention, each recess 109 of the low-profile cap 108 can extend from near the outer edge of the low-profile cap 108 towards the apex of the low-profile cap 108. Furthermore, in implementations where the low-profile cap 108 has a curved profile, each recess 109 of the low-profile cap 108 can increase in depth along its length. In other words, because the height of the portion of the low-profile cap 108 near the apex is greater than the height of the portion of the low-profile cap 108 near its outer edge, the depth of the portion of each recess 109 near the apex of the low-profile cap 108 can be greater than the depth of the portion of each recess 109 near the outer edge of the low-profile cap 108. The varying depth of the recesses 109 can help ensure that there is sufficient surface area for engaging the key elements 122 and that the cap 108 is low-profile.

Figure 6:
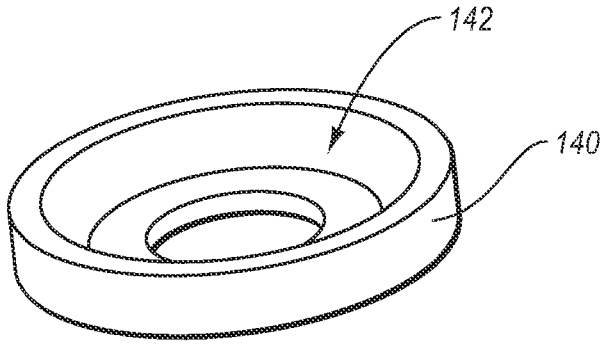
FIG. 6 illustrates a perspective, top view of a spacer bushing in accordance with an implementation of the present invention.

Referring now to FIG. 6, a spacer bushing 140 can comprise a washer like configuration having an increased thickness and a counter-bore 142 formed therein. Similar to the barrel washer 112 and panel washer 114, the spacer bushing 140 can be formed from polytetrafluoroethylene, rubber, nylon, or other suitable material that is light weight, durable, and that can provide a resilient/at least partially flexible barrier between the metal components of the low-profile fastener assembly 110 and a panel. Furthermore, in one or more implementations, the spacer bushing 140 can be formed from a material configured with approximately the same or similar coefficient of thermal expansion as the panel with which it is used. Thus, the spacer bushing 140 can expand and contract at approximately the same rate as a given panel and thereby help ensure that there is an adequate barrier between harder components of the low-profile fastener assembly 110 and a mounted panel 102.

Figure 7:
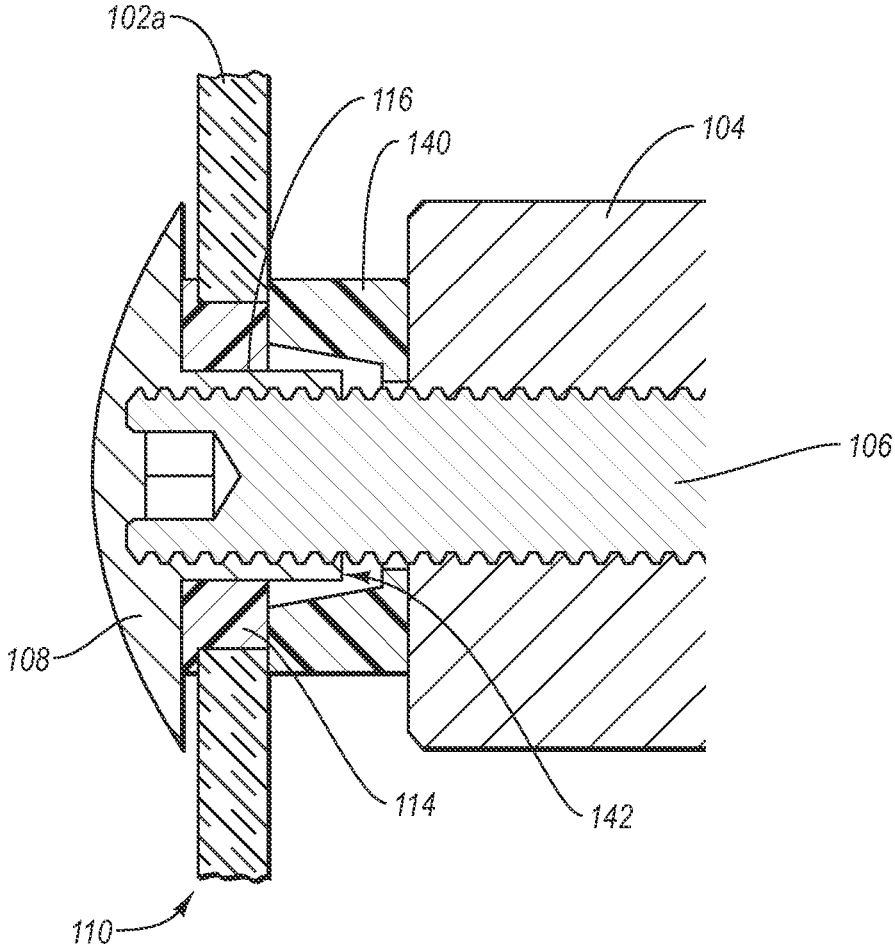
FIG. 7 illustrates a side cross-sectional schematic of a panel mounted using a low-profile fastener assembly and the spacer bushing of FIG. 6 in accordance with an implementation of the present invention.

FIG. 7 illustrates a side cross-sectional view of a panel 102*a* mounted using a low-profile fastener assembly 110 that includes a spacer bushing 140. In particular, FIG. 7 illustrates an implementation in which the gauge of the panel is less than the length of the shoulder 116 of the low-profile cap 108. In order to compensate for the smaller gauge panel 102*a*, a user can position a spacer bushing 140 on the threaded rod 106 between the panel 102*a* and the standoff barrel 104. The counterbore 142 of the spacer bushing 140 can receive the portion of the shoulder 114 of the low-profile cap 108 that extends beyond the panel 102*a*. One will appreciate in light of the disclosure herein that the spacer bushing 140 can help protect the panel 102*a* by preventing it from shifting onto the shoulder 116 of the low-profile cap 108, onto the threads of the threaded rod 106, or against the standoff barrel 104.

Implementations of the present invention also include methods of assembling and securing panels as a partition, display, treatment, barrier, or other structure to a support structure. The following describes at least one implementation of a method of mounting panels 102 to a support structure 101 using low-profile fastener assemblies 110. Of course, as a preliminary matter, one of ordinary skill in the art will recognize that the methods explained in detail can be modified to install a wide variety of configurations using one or more components of the present invention. For example, various acts of the method described can be omitted or expanded, and the order of the various acts of the method described can be altered as desired.

Thus, according to one method of the present invention, at least one panel 102 can be secured to a support structure 101 using at least one low-profile fastener assembly 110. Specifically, with reference to FIGS. 1-7, the method can include a user securing a standoff barrel 104 to a support structure 101. According to some implementations of the present invention, the user can secure the standoff barrel 104 directly to a support structure 101 (i.e., wall, ceiling, floor etc.). For example, the user can secure one end of a threaded member (not shown) into a tapped recess of the distal end 105 of the standoff barrel 104. The user can then secure an opposing end of the threaded member into a reciprocally threaded recess within an anchor secured within or to the support structure 101. One will appreciate in light of the disclosure herein that the user can select an appropriate anchor based on the type of support structure (i.e., wood, concrete, drywall etc.) to (or within) which the anchor is secured.

According to additional implementations of the present invention, a user can secure the standoff barrel 104 indirectly to the support structure 101 via a mounting plate, flange, frame, or other intermediate structure. For example, the user can insert one end of a threaded member, such as a bolt, into the channel of an extruded frame secured to the support structure 101. The user can then secure an opposing end of the threaded member into a tapped recess in the distal end 105 of the standoff barrel 104.

The method can further include threading a first end of the threaded rod 106 into a recess of the standoff barrel 104. In particular, the user can place an end of the threaded rod 106 within the internally threaded receptacle 111 formed within the proximal end 107 of the standoff barrel 104. The user can then manipulate a wrench or screwdriver within the fitting 132 in order to turn the threaded rod 106 into the threaded receptacle 111 of standoff barrel 104.

Once the user has mounted the threaded rod 106 within the standoff barrel 104, the user can position a washer, such as the barrel washer 112 or the spacer bushing 140 onto threaded rod 106 and against the standoff barrel 104. As described herein above, the user can determine whether to use a barrel washer 112 or a spacer bushing 140 based at least in part upon the gauge of the panel 102 being mounted. Additionally, the user can determine whether to use a barrel washer 112 or a spacer bushing 140 based at least in part upon the desire to increase the standoff distance at which the panel 102 is mounted from the support structure 101.

After having positioned a washer on the threaded rod 106, the user can insert a second end of the threaded rod 106 through a perforation 103 in the panel 102. The perforation 103, in turn, can be formed within the panel 102 at a predetermined support location, and can be sized and configured to receive a low-profile fastener assembly 110 therein. One will appreciate that the thinner the gauge of panel 102 used, the fewer the number of support locations that may be needed to support the weight of the panel 102; however, the greater the number of support locations that may be needed to prevent deflection of the panel 102. On the other hand, the thicker the gauge of panel 102, the greater the number of support locations that may be needed to hold the weight of the panel 102; but the lesser the number of support locations that may be needed to prevent defection of the panel 102.

Prior to (or concurrent with) inserting the threaded rod 106 through a perforation 103 in the panel 102, the user can insert a panel washer 114 within the through-hole 103 of the panel 102. In particular, the user can position the hollow, cylindrical body 117 of the panel washer 114 within the perforation 103 of the panel 102 until the flange 115 abuts against the display surface of the panel 102. Once the panel washer 114 is within the panel 102, the panel 102 can be placed on the threaded rod 106.

Because the low-profile fastener assembly 110 includes a two-piece fastener 130, the weight of the panel 102 can be supported by the low-profile fastener assembly 110 prior to securing the low-profile cap 108 onto the threaded rod 106. Thus, the user need not have to attempt to align the threaded rod, washers, and the through-hole 103 in the panel 102, all while supporting the weight of the panel 102 and attempting to tighten a cap or other fastener. Indeed, the user can secure the threaded rod 106 into the standoff barrel 104, position any washers onto the threaded rod 106, position the panel 102 onto the threaded rod 106 or other component of the low-profile fastener assembly 110, and secure the low-profile cap 108 onto the threaded rod 106 in subsequent individual acts.

The user can then secure the panel 102 to the low-profile fastener assembly 110 by tightening the low-profile cap 108 onto the second end of the threaded rod 106. Specifically, the user can insert the shoulder 116 of the low-profile cap 108 within the hollow, cylindrical body 117 of the panel washer 114 and the perforation 103 of the panel 102. Thereafter, the user can place the one or more key elements 122 of the cap key 120 into the one or more recesses 109 of the low-profile cap 108, and turn the cap key 130, thereby tightening the low-profile cap 108 onto the threaded rod 106.

One will appreciate that, in light of the disclosure herein, because the cap key 120 is sized and configured to be held substantially entirely within the palm of a user's hand, the user's hand will necessarily be proximate the low-profile cap 108 and the panel 102 when securing the low-profile cap 108 onto the threaded rod 106. In other words, the user's hand will not be spaced from the low-profile cap 108 and panel 102 by the length of a wrench or screwdriver. The proximity of the user's hand to the low-profile cap 108 and panel 102 can help ensure that the user does not scratch or otherwise damage the panel 102 while attempting to tighten the low-profile cap 108 onto the threaded rod 106.

As the forgoing methods illustrate, systems and components of the present invention can provide a great deal of versatility in mounting panels. In particular, the systems and components of the present invention can allow panels to be secured to support structure using various components that allow for simple and fast assembly. Additionally, the systems and components of the present invention can help protect the panel from damage, while as providing a pleasing aesthetic. Furthermore, the various components of the present invention can be configured to aid in manufacturing ease.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A fastener assembly for securing one or more panels to a structure at a standoff comprising:

a rod comprised of first and second ends joined by an elongated middle portion, at least a portion of said elongated middle portion and said first end of said rod including external threads;

a standoff comprised of first and second ends joined by a middle portion which includes a threaded recess;

said first end of said standoff adapted for threadedly securing said standoff to a support structure;

said second end of said standoff adapted for threadedly securing said first end of said rod within said threaded recess in a manner so that a mounting support is defined by said second end of said rod and at least a second portion of said elongated middle portion of said rod, said mounting support being extendable through one or more perforations in a panel when the panel is mounted to said mounting support of said rod; and a cap having a portion which fits onto said mounting support of said rod, securing the panel onto said mounting support of said rod by securing the panel between said cap on one side of the panel, with said mounting support of said rod extending through the one or more perforations in the panel, and with said standoff being secured on the other side of the panel opposite from said cap, so that together said rod, said standoff, and said cap, when assembled, support and space the panel from the support structure.

2. The assembly as recited in claim 1, wherein said cap includes a head portion and a shoulder portion extending from said head portion, said shoulder portion having internal threads adapted for threadedly securing said cap to said mounting support of said rod.

3. The assembly as recited in claim 2, wherein said head portion is comprised of a curved profile and two or more separated recesses extending into said curved profile, said two or more recesses adapted for receiving corresponding key elements to apply torque to said cap.

4. The assembly as recited in claim 2, further comprising:

a panel washer comprised of a cylindrical body and a flange, said cylindrical body adapted for placing around said shoulder portion of said cap and within the one or more perforations in the panel; and said flange adapted for abutting against said head portion of said cap.

5. The assembly as recited in claim 4, wherein said flange of said washer is adapted for forming a barrier between said cap and the panel.

6. The assembly as recited in claim 2, further comprising a washer comprised of a counterbore adapted for receiving said shoulder portion of said cap.

7. The assembly as recited in claim 6, wherein said washer is adapted for providing a barrier between the panel and said standoff.

8. The assembly as recited in claim 1, wherein, in an assembled configuration, said standoff fixedly connects to said rod, and said rod fixedly connects to said cap.

9. A method of mounting a panel to a support structure at a standoff, the method comprising:

attaching a standoff to a first side of a support structure;

attaching a rod to said standoff such that at least a portion of said rod extends from said standoff as a mounting support;

inserting said mounting support of said rod through a perforation at a first side in a panel facing the first side of the support structure; and at a second side of the panel opposite from the first side of the panel, attaching a cap through the perforation and onto said mounting support of said rod such that the panel is secured between said cap on the second side of the panel and said standoff between the first side of the panel opposite from said cap, with said standoff spacing the panel from the support structure.

10. The method as recited in claim 9, further comprising inserting a cylindrical, hollow-bodied washer within the perforation of the panel to form a protective barrier between the panel and said mounting support of said rod.

11. The method as recited in claim 10, further comprising inserting the rod through said washer to support the panel.

12. The method as recited in claim 9, further comprising positioning a washer on said rod between the panel and said standoff to form a protective barrier between said standoff and the first side of the panel.

13. The method as recited in claim 12, further comprising positioning at least a portion of said cap within a counter-bore of said washer.

14. A fastener assembly for securing one or more panels to a support structure at a standoff comprising:

a rod comprised of first and second ends joined by an elongated middle portion;

a standoff comprised of first and second ends joined by a middle portion; and said first end of the standoff adapted for attaching said standoff to a support structure;

said second end of said standoff and said middle portion of said standoff adapted for attaching to said first end of said rod and a portion of said elongated middle portion of said rod in a manner so that a mounting support is defined by said second end of said rod and at least a second portion of said elongated middle portion of said rod, said mounting support of said rod being extendable through one or more perforations in a panel when the panel is mounted to said mounting support of said rod;

a cap having a portion which fits into at least one of the perforations and which fits onto and attaches to said mounting support of said rod, securing the panel onto said mounting support of said rod by securing said panel between said cap on a first side of the panel, with said mounting support of said rod extending through the one or more perforations in a the panel, and with said standoff being secured on a second side of the panel opposite from said cap on the first side of the panel, so that together said rod, said standoff, and said cap, when assembled, support and space the panel from the support structure; and a protective element configured to provide a barrier between the cap and the panel, the protective element comprising:

a first portion positioned between the cap and the first side of the panel;

and a second portion positioned within the at least one perforation in the panel, between the panel and the portion of the cap which fits into the least one perforation.

15. The fastener assembly of claim 14, wherein said second end of said standoff includes a threaded recess adapted for threadedly coupling said first end of said rod to said standoff.

16. The fastener assembly of claim 14, wherein said cap and said standoff are substantially concentric relative to one another when the panel is secured between said cap and said standoff.

17. A method of mounting a panel to a support structure at a standoff, the method comprising:

securing a standoff including a threaded recess to a first side of a support structure;

threadedly securing a threaded rod within said threaded recess of said standoff such that at least a portion of said rod extends from said standoff as a mounting support;

inserting said mounting support of said rod through a perforation at a first side in a panel facing the first side of the support structure; and at a second side of the panel opposite from the first side of the panel, inserting a cap having internal threads through the perforation and threadedly securing said internal threads of said cap onto said mounting support of said rod such that the panel is secured between said cap on the second side of the panel and said standoff between the first side of the panel opposite from said cap, with said standoff spacing the panel from the support structure.

18. A fastener assembly for securing one or more panels to a support structure at a standoff comprising:

a rod comprised of first and second ends joined by an elongated middle portion;

a rigid standoff comprised of first and second ends joined by a middle portion;

and said first end of the rigid standoff adapted for attaching said rigid standoff to a support structure;

said second end of said rigid standoff and said middle portion of said rigid standoff adapted for attaching to said first end of said rod and a portion of said elongated middle portion of said rod in a manner so that a mounting support is defined by said second end of said rod and at least a second portion of said elongated middle portion of said rod, said mounting support of said rod being extendable through one or more perforations in a panel when the panel is mounted to said mounting support of said rod;

and a cap having a portion which fits onto and attaches to said mounting support of said rod, securing the panel onto said mounting support of said rod by securing said panel between said cap on one side of the panel, with said mounting support of said rod extending through the one or more perforations in the panel, and with said rigid standoff being secured on the other side of the panel opposite from said cap, so that together said rod, said rigid standoff, and said cap, when assembled, support and space the panel from the support structure and hold the panel in a substantially stationary position.

* * * * *

UNITED STATES PATENT AND TRADEMARK OFFICE

CERTIFICATE OF CORRECTION

PATENT NO. : 8,628,049 B2
APPLICATION NO. : 13/056083
DATED : January 14, 2014
INVENTOR(S) : Ghatikar et al.

It is certified that error appears in the above-identified patent and that said Letters Patent is hereby corrected as shown below:

In the Specification

Column 4
Line 50, shift the "FIG. 3" description to the line below for a new paragraph Column 9
Line 11, change "101 by." to --101.--
Line 46, change "cap key 102" to --cap key 120--

Column 11
Line 60, change "shoulder 114" to --shoulder 116--

Column 13
Line 36, change "cap key 130" to --cap key 120--

Signed and Sealed this
Twenty-seventh Day of May, 2014

Michelle K. Lee

Michelle K. Lee
*Deputy Director of the United States Patent and Trademark Office*